US005302573A

United States Patent [19]

Ohyama et al.

[11] Patent Number: 5,302,573

[45] Date of Patent: Apr. 12, 1994

[54] TRANSFER SHEET FOR SUBLIMATION RECORDING

[75] Inventors: Tsukasa Ohyama; Yasushi Shimokawa; Keisuke Takuma, all of Ohmuta; Isamu Ghoda, Kobe; Hitoshi Koshida, Nishinomiya; Akitoshi Igata, Ohmuta, all of Japan

[73] Assignee: Mitsui Toatsu Chemicals, Inc., Tokyo, Japan

[21] Appl. No.: 996,426

[22] Filed: Dec. 23, 1992

Related U.S. Application Data

[60] Division of Ser. No. 766,193, Sep. 27, 1991, abandoned, which is a continuation-in-part of Ser. No. 721,340, Jul. 1, 1991, abandoned.

[30] Foreign Application Priority Data

Dec. 28, 1988 [JP] Japan ..... 63-328899
Mar. 28, 1990 [JP] Japan ..... 2-076572

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,452,609 6/1984 Hamprecht ..... 8/694
4,479,899 10/1984 Hamprecht ..... 260/205
4,769,449 9/1988 Bühler et al. ..... 534/854
4,908,042 3/1990 Bühler et al. ..... 8/639

FOREIGN PATENT DOCUMENTS 61-227092 10/1986 Japan ..... 503/227
2-175295 7/1990 Japan ..... 503/227
3-007389 1/1991 Japan ..... 503/227

*Primary Examiner*—B. Hamilton Hess
*Attorney, Agent, or Firm*—Millen, White, Zelano, & Branigan

[57] ABSTRACT

A magenta dyestuff for sublimation heat transfer recording is here disclosed which is represented by the formula (I)

(I)

wherein $R^1$ is an alkyl group or alkoxy group, $R^2$ is an alkyl group, aryl group or halogenoalkyl group, $R^3$ is an alkyl group, aryl group, alkoxyalkyl group, cyanoalkyl group, alkylcarboxyalkyl group or halogenoalkyl group, X is a hydrogen atom or alkoxy group, and Y is a hydrogen atom, alkoxy group, alkylcarbonylamino group or alkyl-sulfonylamino group, and this dyestuff is excellent in solubility, ribbon shelf stability, dye-fixing properties, durability and light resistance.

10 Claims, No Drawings

TRANSFER SHEET FOR SUBLIMATION RECORDING

This is a division of application Ser. No. 07/766,193, now abandoned, filed Sep. 27, 1991, which is a continuation-in-part of application Ser. No. 07/721,340, filed Jul. 1, 1991, now abandoned.

BACKGROUND OF THE INVENTION (i) Field of the Invention

The present invention relates to a magenta dyestuff for sublimation transfer recording.

A heat transfer system using a sublimable dyestuff is a printing system in which a thin condenser paper having a thickness of several microns or a PET film is coated with the sublimable dyestuff in the state of an ink, and this dyestuff is then selectively heated with a heat-sensitive head to transfer an image to the recording paper. In these days, this heat transfer system has been used as a means for recording (hardcopying) various information images.

The sublimable dyestuff used herein is characterized by being rich in colors, excellent in color-mixing properties, and having strong dye-fixing power and relatively high stability. Accordingly, the above-mentioned heat transfer system using this kind of sublimable dyestuff has an important feature that the amount of the dyestuff to be sublimed depends upon heat energy and the density of the fixed dyestuff can be analogically controlled. This feature is not present in other image-recording systems.

Most of azo dyestuffs which have been heretofore suggested (Japanese Patent Application Laid-open No. 61-227092) usually have high molar extinction coefficients and latently possess transfer power necessary to obtain the sufficient density of transferred images. However, on the other hand, they have insufficient solubility and poor compatibility with ribbon binders, and thus these dyestuffs tend to crystallize on ribbons, so that the heat transfer efficiency of the dyestuffs is noticeably impaired. Furthermore, after the transfer, when brought into contact with the dyestuffs, matters are soiled therewith and the quality of the images themselves deteriorates because of the poor dye-fixing power of the dyestuffs. In addition, since most of these dyestuffs are poor in durability, particularly light resistance which is most important, they cannot withstand a long-term storage. Hence, the dyestuffs which can solve all of these problems are extremely limited.

SUMMARY OF THE INVENTION

An object of the present invention is to provide a magenta dyestuff for sublimation heat transfer which is excellent in solubility, dye-fixing properties, durability and light resistance.

The present inventors have intensively conducted research to solve the above-mentioned problems, and as a result, they have found that a compound represented by the following formula (I) can become an excellent dyestuff for sublimation heat transfer. On the basis of this knowledge, the present invention has been completed.

That is, the present invention is directed to a magenta dyestuff for sublimation heat transfer recording represented by the formula (I)

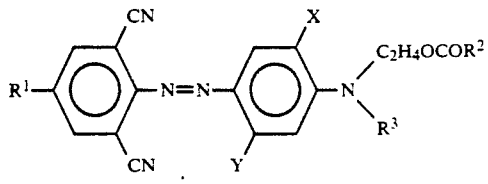

(I)

wherein $R^1$ is an alkyl group or alkoxy group, $R^2$ is an alkyl group,-aryl group or halogenoalkyl group, $R^3$ is an alkyl group, aryl group, alkoxyalkyl group, cyanoalkyl group, alkylcarboxyalkyl group or halogenoalkyl group, X is a hydrogen atom or alkoxy group, and Y is a hydrogen atom, alkoxy group, alkylcarbonylamino group or alkylsulfonylamino group.

The particularly preferable magenta dyestuff is a compound represented by the formula (II)

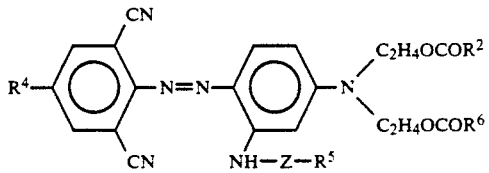

(II)

each of $R^4$, $R^5$ and $R^6$ is independently an alkyl group having 1 to 8 carbon atoms which may branch, and Z is —CO— or —$SO_2$—.

When the magenta dyestuff represented by the formula (I) or (II) of the present invention is heat-transferred, the amount of the dyestuff to be sublimely transferred can be controlled by regulating energy which is applied to a heat-sensitive head, and therefore the recording of gradated images is possible. For this reason, the magenta dyestuff of the present invention is suitable for full color recording.

Furthermore, the magenta dyestuff is stable to heat, light, humidity and chemicals, and therefore it does not bring about thermal decomposition during transfer recording, and so the shelf stability of images recorded by using the magenta dyestuff is also excellent.

In addition, the dyestuff of the present invention is excellent in solubility in an organic solvent and dispersion in water, and thus it permits easy preparation of an ink having a high density in which the dyestuff is uniformly dissolved or dispersed. As a result, the dyestuff can provide recorded images having a good color density, and therefore it can be considered that the dyestuff of the present invention is a practically valuable dyestuff.

DETAILED DESCRIPTION OF THE PREFERRED EMBODIMENTS

Next, the present invention will be described in detail.

In the above-mentioned formula (I), examples of an alkyl group represented by $R^1$, $R^2$, $R^3$, $R^4$, $R^5$ and $R^6$ include straight-chain alkyl groups such as a methyl group, ethyl group, n-propyl group, n-butyl group, n-pentyl group, n-hexyl group, n-heptyl and n-octyl group, and branched alkyl groups such as an iso-propyl group, iso butyl group, sec-butyl group, tert-butyl group, 3-methylbutyl group, 3,3-dimethylbutyl, 2-methyl-butyl, 2,2-dimethylbutyl and 2,3-dimethylbutyl.

Example of an alkoxy group represented by $R^1$, X and Y include a methoxy group, ethoxy group, n-propoxy group, n-butoxy group, iso-butoxy group, tert-butoxy group and n-hexyloxy group.

Examples of an alkylcarboxylalkyl group represented by $R^3$ include a methylcarboxymethyl group, methylcarboxyethyl group, ethylcarboxymethyl group and ethyl-carboxyethyl group.

Examples of an aryl group represented by $R^2$ and $R^3$ include a phenyl group and methylphenyl group. Examples of a cyanoalkyl group represented by $R^3$ include a cyanomethyl group and cyanoethyl group. Examples of a halogenoalkyl group represented by $R^2$ and $R^3$ include a chloromethyl group and chloroethyl group.

Examples of an alkoxyalkyl group represented by $R^3$ include a methoxymethyl group, methoxyethyl group, ethoxymethyl group and ethoxyethyl group.

Preferable examples of $R^1$ include a methyl group, group, n-propyl group, n-butyl group, iso-propyl group, iso-butyl group and tert-butyl group.

A preferable example of $R^3$ is a compound represented by $C_2H_4OCOR^6$.

Preferable examples of Y are alkylcarbonylamino groups and alkylsulfonylamino groups, and they can be represented by —NH—Z—$R^5$ (Z is —CO— or —$SO_2$—). Typical examples thereof include a methylcarbonylamino group, ethylcarbonylamino group, propylcarbonylamino group, butylcarbonylamino group, methylsulfonylamino group and ethylsulfonylamino group.

According to the research of the present inventors, it has been found that the sublimation rate of the sublimation transfer type dyestuff in a transfer step is generally connected with the interaction between the molecules of these dyestuffs and the interaction between the molecules of the dyestuff and a binder resin for an ink.

That is, even if the molecular weight of the dyestuff increases to some extent, the dyestuff having a good solubility in an ink solvent and a low melting point is preferred. In addition, it has been found that the best dyestuff is one wherein the interaction between the dyestuff and the binder resin for an ink is as small as possible, so long as the shelf stability of a manufactured ribbon is not impaired. The dyestuff represented by the formula (I) of the present invention can meet the above-mentioned requirements and can provide a satisfactory sublimation rate.

The dyestuff represented by the formula (I) of the present invention can be obtained by an ordinary process, i.e., by diazotizing 4 substituted-2,6-dibromoaniline, carrying out-a coupling reaction with a suitable aniline, and then introducing cyano groups thereinto. For example, the dyestuff can be prepared in accordance with the following reaction scheme:

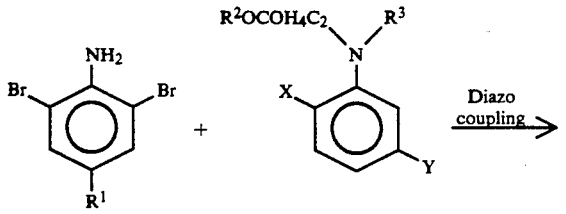

-continued

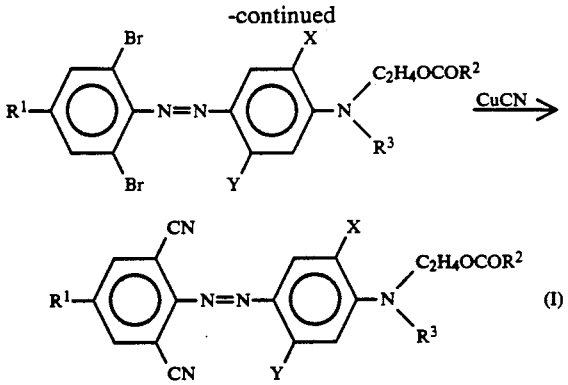

(I)

The preparation of an ink for heat-sensitive transfer recording by the use of the dyestuff of the present invention can be achieved by mixing the dyestuff with a suitable resin, solvent and the like. Furthermore, the heat transfer can be effected by the following procedure. That is, a suitable substrate is coated with the ink obtained in the above-mentioned manner to form a transfer sheet. This sheet is superposed upon a material to be recorded and then heated and pressed from the back surface of the sheet by means of a heat-sensitive recording head, whereby the dyestuff on the sheet is transferred to the material to be recorded.

The resin which is used to prepare the above-mentioned ink may be those employed in a usual printing ink, and examples of this resin include oil soluble resins such as a rosin, phenolic resin, xylene resin, petroleum resin, vinyl resin, polyamide, alkyd resin, nitrocellulose and an alkylcellulose; and water soluble resins such as a maleic acid resin, acrylic resin, casein, shellac and glue.

Examples of the solvent which can be used to prepare the ink include alcohols such as methanol, ethanol, propanol and butanol; cellosolves such as methyl cellosolve and ethyl cellosolve; aromatic hydrocarbons such as benzene, toluene and xylene; esters such as ethyl acetate and butyl acetate; ketones such as acetone, methyl ethyl ketone and cyclohexanone; hydrocarbons such as ligroin, cyclohexane and kerosine; and dimethylformamide. When the water soluble resin is used, water or a mixture of water and the above-mentioned solvent can be utilized as the solvent.

Preferable examples of the substrate which is coated with the ink include thin papers such as a condenser paper and glassine paper; and plastic films having good heat resistance such as polyester, polyamide and polyimide. In order to increase the heat transfer efficiency from the heat-sensitive recording head to the dyestuff, the proper thickness of the substrate should be in the range of from about 5 to 50 μm.

Examples of the material to be recorded include fibers, fabrics, films, sheets and molded articles made of polyolefin resins such as polyethylene and polypropylene; halogenated polymers such as polyvinyl chloride and polyvinylidene chloride; vinyl polymers such as polyvinyl alcohol, polyvinyl acetate and polyacrylic ester; polyester resins such as polyethylene terephthalate and polybutylene terephthalate; polystyrene resin; polyamide resin; copolymer resins of olefins such as ethylene and propylene and another vinyl monomer; ionomer; cellulose resins such as cellulose diacetate and cellulose triacetate; polycarbonate, polysulfone, polyimide and the like. The particularly preferable materials are fabrics, sheets and films made of polyethylene terephthalate.

In the present invention, a paper coated or permeated with the above-mentioned resin containing acidic fine grains such as silica gel, a paper on which a resin film is laminated, or a specific acetylated paper can be used so as to obtain good records having an excellent image stability under conditions of a high temperature and a high humidity. In addition, films of various resins and synthetic papers made of these films can also be employed.

Moreover, after the transfer recording, for example, a polyester film can be heat-pressed and laminated on the transfer-recorded surface of the material to improve the color development of the dyestuff and to maintain and stabilize the record.

Now, the present invention will be described in detail in reference to examples. In this connection, "part" and "parts" in the examples means "part by weight" and "parts by weight", respectively.

EXAMPLE 1

A synthetic process of a compound represented by the formula (A)

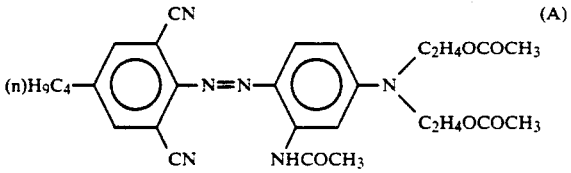

will be described.

In the first place, 7 parts of 2,6-dibromo-4-n-butylaniline were dissolved in 12.4 parts of 98% sulfuric acid, and 10.6 parts of 30% nitrosylsulfuric acid were added thereto at 0° C. and reaction was then carried out for 1 hour. Afterward, the reaction solution was poured into 40 parts of ice water, and a solution of 8 parts of 3-N,N-bis(acetoxyethyl)acetonanilide and 10 parts of acetic acid was added dropwise thereto, while 0° C. was maintained. After the reaction for 3 hours, the reaction solution was filtered to obtain 14.8 parts of 2-(2,6-dibromo-4-n-butylphenylazo)-5-N,N-bis(acetoxyethyl)acetoanilide.

Furthermore, 4.5 parts of cuprous cyanide were added to 60 parts of DMF, and after heating at 80° C. for 1 hour, a solution of 14.8 parts of the previously synthesized 2-(2,6-dibromo-4-n-butylphenylazo)-5-N,N-bis(acetoxyethyl)acetoanilide and 62 parts of DMF was added dropwise thereto and reaction was then carried out at the same temperature for 1 hour. After completion of the reaction, the reaction solution was poured into 130 parts of to remove the remaining cuprous cyanide therefrom, thereby obtaining 11 parts of 2-(2,6-dicyano-4-n-dibutyl-phenylazo)-5-N,N-bis-(acetoxyethyl)acetoanilide represented by the above-mentioned formula (A).

The absorption maximum wave length (λmax) of this compound in toluene was 515 nm.

An ink, a transfer sheet and a material to be recorded were prepared in accordance with the undermentioned procedure by the use of the above-mentioned compound (A), and transfer recording was then carried out.

(i) Preparation of the Ink

| | |
|---|---|
| Dyestuff of the formula (A) | 3 parts |
| Polybutylal resin | 4.5 parts |
| Methyl ethyl ketone | 46.25 parts |
| Toluene | 46.25 parts |

These materials were mixed and then treated by a paint conditioner using glass beads for about 30 minutes to prepare the ink.

(ii) Preparation of the Transfer Sheet

A polyethylene terephthalate (PET) film having a thickness of 9 μm whose back surface was subjected to a heat resistance treatment was coated with the above-mentioned ink by the use of a gravure corrector (print depth 30 μm) so that a dry coating weight might be 1.0 g/m$^2$, followed by drying.

(iii) Preparation of Material to be Recorded

| | |
|---|---|
| Polyester resin (trade name VYLON 103, made by Toyobo Co., Ltd., Tg = 47° C.) | 0.8 part |
| EVA high polymeric plasticizer (trade name ELVALOY 741p, made by Mitsui Poly-chemical Co., Ltd., Tg = −37° C.) | 0.2 part |
| Amino-modified silicone (trade name KF-857, made by The Shin-Etsu Chemical Co., Ltd.) | 0.04 part |
| Epoxy-modified silicone (trade name KF-103, made by The Shin-Etsu Chemical Co., Ltd.) | 0.04 part |
| Methyl ethyl ketone/toluene/cyclohexane (weight ratio 4:4:2) | 9.0 parts |

These materials were mixed to prepare a coating solution, and a synthetic paper (trade name Yupo FPG#150, made by Oji Yuka Co., Ltd.) was coated with the coating solution by the use of a bar coater (made by RK Print Coat Instruments Co., Ltd., No. 1) so that a dry coating weight might be 4.5 g/m$^2$, followed by drying at 100° C. for 15 minutes.

(iv) Transfer Recording

The transfer sheet was superposed upon the material to be recorded so that the ink-coated surface of the former might confront the coating solution-coated surface of the latter, and recording was then carried out by heating the back surface of the heat transfer sheet with a heat-sensitive head under conditions of a head application voltage=10 V and a recording time=4.0 milliseconds, whereby a magenta color having a color density of 2.75 was recorded thereon. In this connection, the color density was measured by the use of a densitometer RD-514 model-(filter: Latten No. 58) made by Macbeth Co., Ltd. in USA.

The color density was calculated in accordance with the following formula.

The color density $=\log_{10}(I_O/I)$, $I_O$=Intensity of the reflected light from a standard white reflective plate I=Intensity of the reflected light from the test specimen.

In a light resistance test, the obtained record was irradiated with light of 120 KJ by the use of a xenon fade meter (made by Suga Testing Machine Co., Ltd.). As a result, the residual ratio of the color density was 98.0%, which meant that the color change of the recorded image was scarcely observed. In addition, the recorded image was also excellent in stability under conditions of a high temperature and a high humidity.

Fastness of the recorded image was evaluated by allowing this image to stand in an atmosphere at 50° C. for 48 hours, and then observing the sharpness of the image and a coloring state on a white paper with which the recorded image was rubbed. According to this evaluation, the sharpness of the image did not change, and the white paper was not colored, which meant that the fastness of the recorded image was good.

Example 2

The synthetic process of a compound represented by the formula (B)

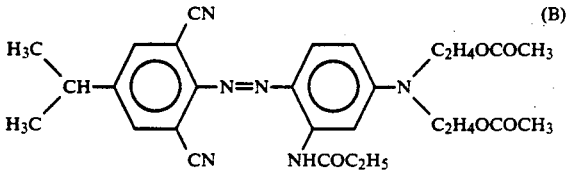

will be described.

In the first place, 6.7 parts of 2,6-dibromo-4-isopropylaniline were dissolved in 12.4 parts of 98% sulfuric acid, and 10.6 parts of 30% nitrosylsulfuric acid were added thereto at 0° C. and reaction was then carried out for 1 hour. Afterward, the reaction solution was poured into 40 parts of ice water, and a solution of 8.4 parts of 3-N,N-bis(acetoxyethyl)propionylanilide and 10 parts of acetic acid was added dropwise thereto, while 0° C. was maintained. After the reaction for 3 hours, the reaction solution was filtered to obtain 15.2 parts of 2-(2,6-dibromo 4-iso-propylphenylazo)-5-N,N-bis(acetoxyethyl)propionylanilide.

Furthermore, 4.8 parts of cuprous cyanide were added to 60 parts of DMF, and after heating at 70° C. for 1 hour, a solution of 15.2 parts of the previously synthesized 2-(2,6-dibromo-4-iso-butylphenylazo) 5-N,N-bis(acetoxyethyl)propionylacetoanilide and 64 parts of DMF was added dropwise and-reaction was then carried out at the same temperature for 1 hour. After completion of the reaction, the reaction solution was poured into 130 parts of water to remove the remaining cuprous cyanide therefrom, thereby obtaining 13 parts of 2-(2,6-dicyano-4-isopropylphenylazo)-5-N,N-bis(acetoxyethyl)propionylanilide represented by the above-mentioned formula (B).

The absorption maximum wave length (λmax) of this compound in toluene was 515 nm.

An ink, a transfer sheet and a material to be recorded were prepared by the use of the above-mentioned compound (B), and transfer recording was then carried out by the same procedures as in Example 1, thereby obtaining the record of a magenta color having a color density of 2.73.

The obtained image was subjected to a light resistance test by the same procedure as in Example 1. As a result, the residual ratio of of the color density was 97.9%, and the recorded image was also excellent in stability under conditions of a high temperature and a high humidity.

A fastness test was made in the same manner as in Example 1. As a result, the sharpness of the image did not change, and a white paper was not colored, which meant that the fastness of the recorded image was good.

EXAMPLES 3 TO 15

Azo dyestuffs shown in Table 1 were prepared, and an ink, transfer sheets and materials to be recorded were prepared and transfer recording was then carried out by the same procedure as in Example 1, so that records having various color densities shown in Table 1 were obtained.

All of these records were subjected to a light resistance test in the same manner as in Example 1. As a result, all the records scarcely changed as shown in Table 1, and they were also excellent in stability under conditions of a high temperature and a high humidity.

A fastness test was made in the same manner as in Example 1. As a result, the sharpness of the images did not change, and white papers were not colored, which meant that the fastness of the recorded images was good.

TABLE 1

| Example No. | Structural Formula of Dyestuff | Density of Transferred Color | Light Resistance (%) |
|---|---|---|---|
| 3 | 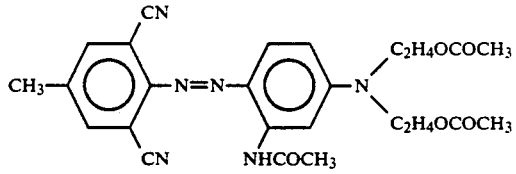 | 2.75 | 98.2 |
| 4 | 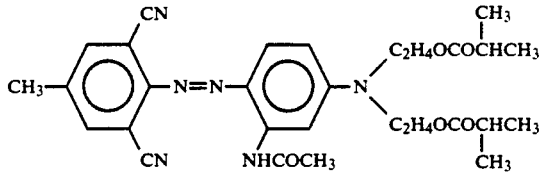 | 2.72 | 97.8 |
| 5 | 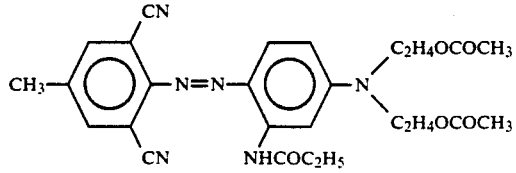 | 2.73 | 98.0 |

TABLE 1-continued
| Example No. | Structural Formula of Dyestuff | Density of Transferred Color | Light Resistance (%) |
|---|---|---|---|
| 6 | 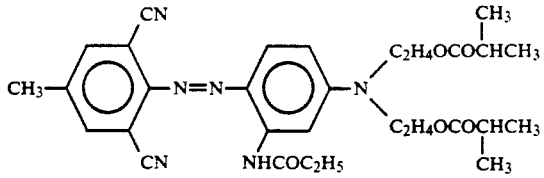 | 2.71 | 97.5 |
| 7 | 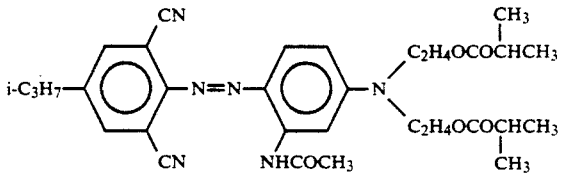 | 2.70 | 97.4 |
| 8 | 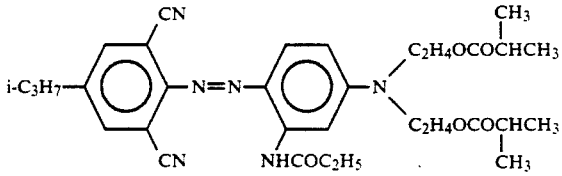 | 2.70 | 97.4 |
| 9 | 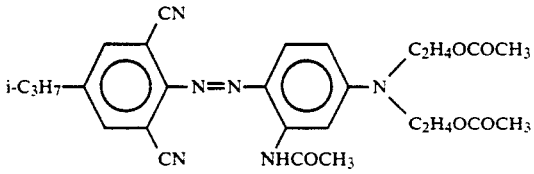 | 2.74 | 98.0 |
| 10 | 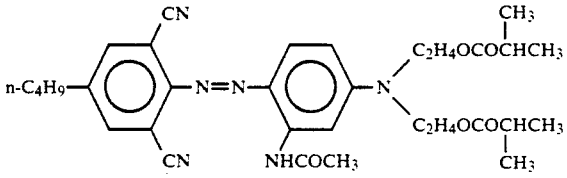 | 2.70 | 97.5 |
| 11 | 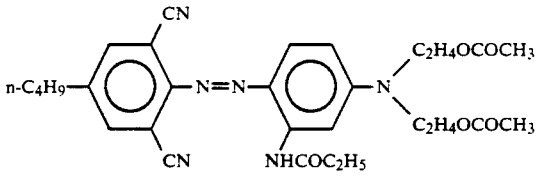 | 2.73 | 98.2 |
| 12 | 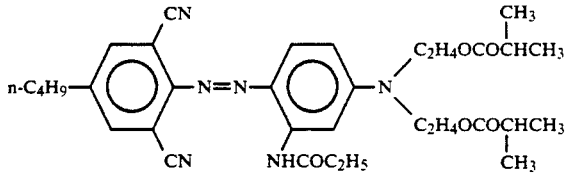 | 2.68 | 97.4 |
| 13 | 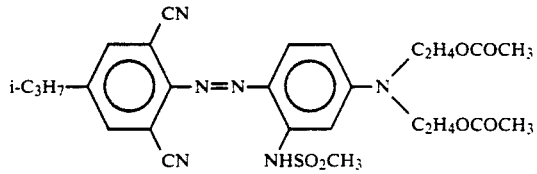 | 2.65 | 92.3 |

TABLE 1-continued

| Example No. | Structural Formula of Dyestuff | Density of Transferred Color | Light Resistance (%) |
|---|---|---|---|
| 14 | 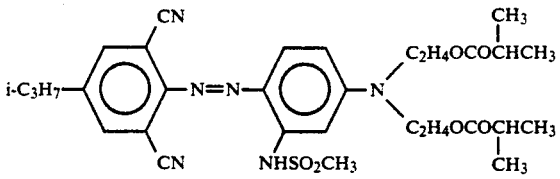 | 2.61 | 92.0 |
| 15 | 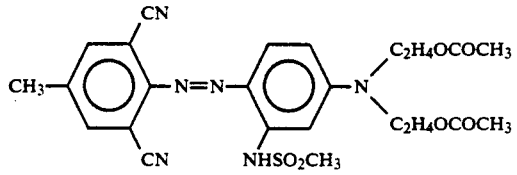 | 2.61 | 92.5 |

COMPARATIVE EXAMPLE 1

An ink, transfer sheets and materials to be recorded were prepared by the use of a compound represented by the formula (C)

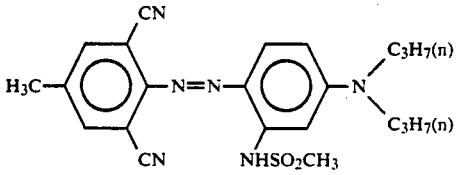

(C)

and transfer recording was then carried out by the same procedure as in Example 1.

At the time of the transfer, a color density was stopped at 2.1, because the dyestuff was crystallized on a ribbon. This record was subjected to a light resistance test in the same manner as in Example 1. As a result, discoloration was noticeable and the residual ratio of the color density was 49.8%. Particularly, in the record portion having a low density, yellow discoloration or color disappearance occurred. In addition, in a fastness test, a slight soil was confirmed on a white paper, when the surface of the image was rubbed with the white paper.

COMPARATIVE EXAMPLES 2 TO 5

Each of azo dyestuffs shown in Table 2 was prepared in the same manner as in Example 1, and an ink, transfer sheets and materials to be recorded were prepared and transfer recording was then carried out by the same procedure as in Example 1. For the recorded images, light resistance was measured. The results are set forth in Table 2.

As is apparent from the results in Tables 1 and 2, the dyestuffs of the present invention exhibited more excellent light resistance as compared with the dyestuffs of the comparative examples.

TABLE 2

| Comparative Example No. | Structural Formula of Dyestuff | Light Resistance (%) |
|---|---|---|
| 2 | 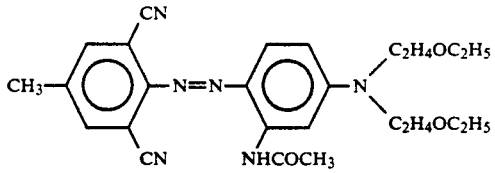 | 58.0 |
| 3 | 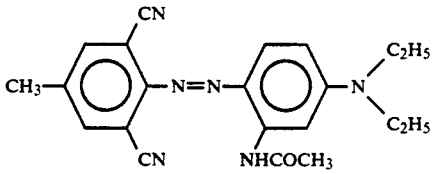 | 55.6 |
| 4 | 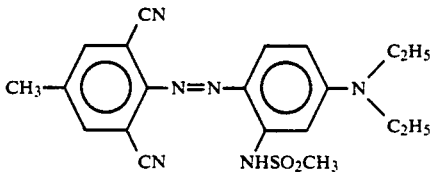 | 50.3 |

TABLE 2-continued

| Comparative Example No. | Structural Formula of Dyestuff | Light Resistance (%) |
|---|---|---|
| 5 | 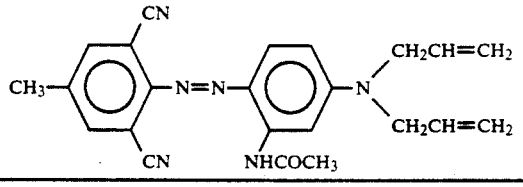 | 32.5 |

EXAMPLES 16 TO 18 AND COMPARATIVE EXAMPLES 6 TO 11

Each of azo dyestuffs shown in Table 3 was prepared in accordance with the same procedure as in Example 1, and its solubility in a 1:1 mixed solution of toluene and methyl ethyl ketone was measured.

Furthermore, for the dyestuffs shown in the same table, ribbon shelf stability was measured.

The ribbon shelf stability was evaluated from a crystallization degree of each dyestuff observed through an optical microscope, after each ribbon was allowed to stand at room temperature for 2 weeks. Ranking was made by expressing the unchanged and uniformly transparent ribbon with "O", the partially and slightly crystallized ribbon with "Δ", and the completely crystallized ribbon with "X". The results are set forth in Table 3.

As is apparent from the results in Table 3, the dyestuffs of the present invention were more excellent in solubility and ribbon shelf stability as compared with the dyestuffs of the comparative examples.

TABLE 3

| | Structural Formula of Dyestuff | Solubility | Ribbon Shelf Stability |
|---|---|---|---|
| Example 16 | 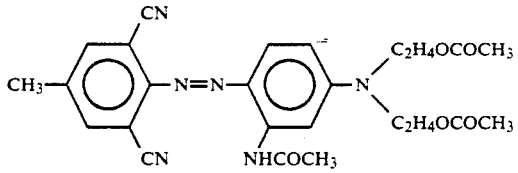 | 5.5 | ○ |
| Example 17 | 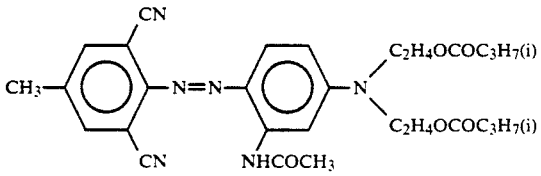 | 8.3 | ○ |
| Example 18 | 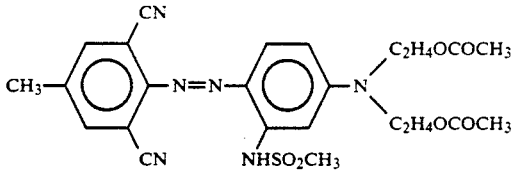 | 4.5 | ○ |
| Comp. Ex. 6 | 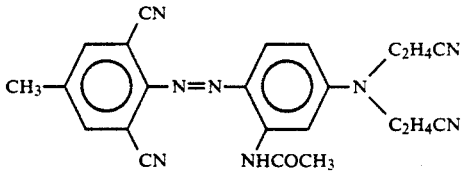 | 0.8 | X |
| Comp. Ex. 7 | 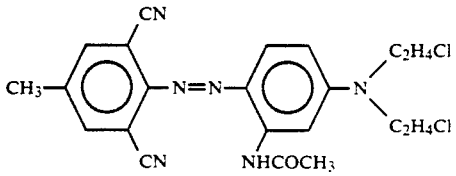 | 1.5 | X |

TABLE 3-continued

| | Structural Formula of Dyestuff | Solubility | Ribbon Shelf Stability |
|---|---|---|---|
| Comp. Ex. 8 | 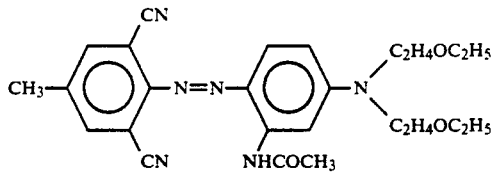 | 4.3 | ○ |
| Comp. Ex. 9 | 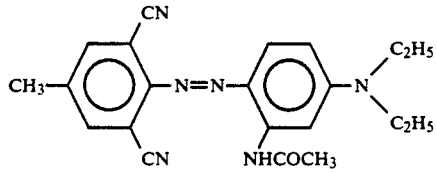 | 3.5 | Δ |
| Comp. Ex. 10 | 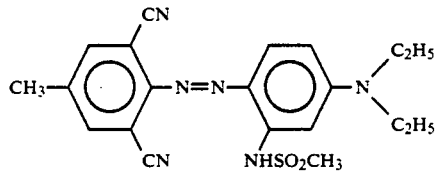 | 2.8 | X |
| Comp. Ex. 11 | 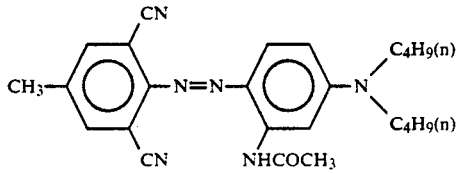 | 4.0 | Δ |

EXAMPLES 19 TO 26

Azo dyestuffs shown in Table 4 were prepared in accordance with the same procedure as in Example 1, and an ink, transfer sheets and materials to be recorded were prepared and transfer recording was then carried out by the same procedure as in Example 1, so that records having various color densities shown in Table 4 were obtained.

For the obtained records, a light resistance test was carried out at a black panel temperature of 63°±2° C. by the use of a xenon fade meter (made by Suga Testing Machine Co., Ltd.). As a result, discoloration was scarcely observed even after the irradiation for 40 hours, and the images were also excellent in stability under conditions of a high temperature and a high humidity.

A fastness test was made in the same manner as in Example 1. As a result, the sharpness of the images did not change, and white papers were not colored, which meant that the fastness of the recorded images was good.

TABLE 4

| Example No. | Structural Formula of Dyestuff | Density of Transferred Color |
|---|---|---|
| 19 | 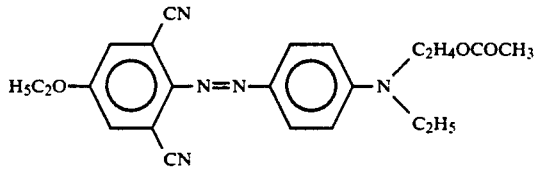 | 2.70 |
| 20 | 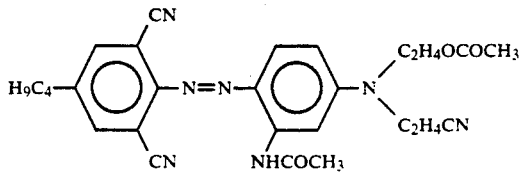 | 2.69 |

TABLE 4-continued

| Example No. | Structural Formula of Dyestuff | Density of Transferred Color |
|---|---|---|
| 21 | 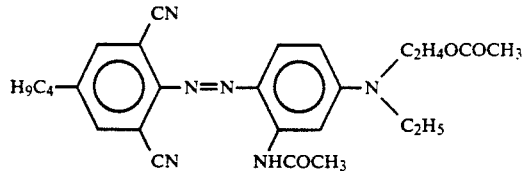 | 2.68 |
| 22 | 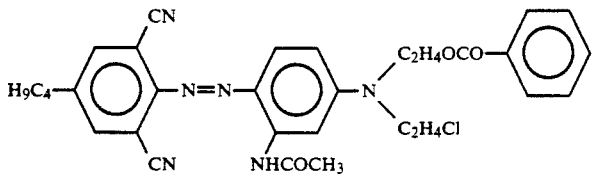 | 2.60 |
| 23 | 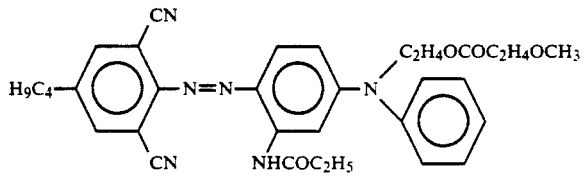 | 2.64 |
| 24 | 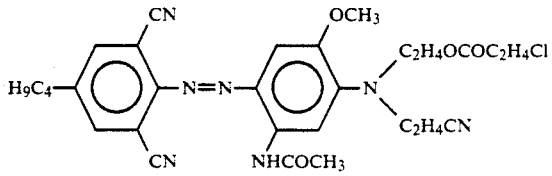 | 2.65 |
| 25 | 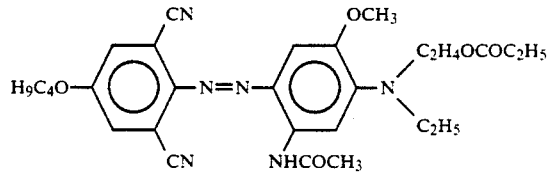 | 2.65 |
| 26 | 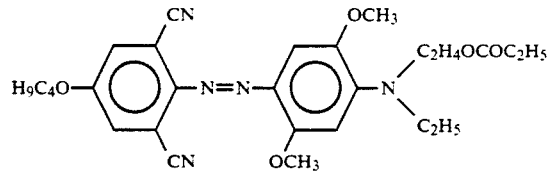 | 2.67 |

What is claimed is:

1. A transfer sheet adapted for sublimation heat transfer recording which comprises a substrate and an ink layer containing at least one dyestuff which is coated onto one side of the substrate, wherein the ink layer contains a magenta dyestuff represented by the formula

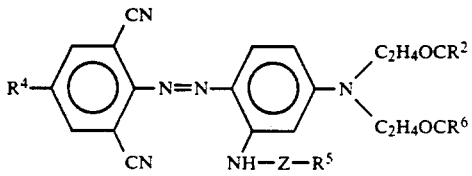

wherein $R^2$ is an alkyl group, an aryl group or a halogenoalkyl group $R^4$, $R^5$ and $R^6$ are independently an alkyl group having 1 to 8 carbon atoms which may be branched, and Z is —CO— or —$SO_2$—.

2. A transfer sheet according to claim 1, wherein $R^2$ and $R^6$ in the formula each is alkyl.

3. A transfer sheet according to claim 1, wherein $R^2$ and $R^6$ in the formula each is methyl, ethyl or i-propyl.

4. A transfer sheet according to claim 1, wherein $R^4$ in the formula is methyl, i-propyl or n-butyl.

5. A transfer sheet according to claim 1, wherein $R^5$ in the formula is methyl or ethyl.

6. A transfer sheet according to claim 1, wherein Z is —CO—.

7. A transfer sheet according to claim 1, wherein Z is —$SO_2$—.

8. A transfer sheet according to claim 1, wherein $R^2$ and $R^6$ in the formula each is alkyl; wherein $R^2$ and $R^6$ in the formula each is methyl, ethyl or i-propyl; wherein $R^4$ in the formula is methyl, i-propyl or n-butyl; wherein $R^5$ in the formula is methyl or ethyl; and wherein Z is —CO—.

9. A transfer sheet according to claim 1, wherein $R^2$ and $R^6$ in the formula each is alkyl; wherein $R^2$ and $R^6$ in the formula each is methyl, ethyl or i-propyl; wherein $R^4$ in the formula is methyl, i-propyl or n-butyl; wherein $R^5$ in the formula is methyl or ethyl; and wherein Z is $—SO_2—$.

10. A transfer sheet according to claim 1, wherein $R^2$ and $R^6$ is the formula each is alkyl; wherein $R^2$ and $R^6$ in the formula each is methyl, ethyl or i-propyl; wherein $R^4$ in the formula is methyl, i-propyl or n-butyl; wherein $R^5$ in the formula is methyl or ethyl; and wherein the ink layer comprises an oil soluble resin.

* * * * *